US008007078B2

(12) United States Patent
Haluzak et al.

(10) Patent No.: US 8,007,078 B2
(45) **Date of Patent: *Aug. 30, 2011**

(54) MICROFLUIDIC DEVICE AND A FLUID EJECTION DEVICE INCORPORATING THE SAME

(75) Inventors: Charles C Haluzak, Corvallis, OR (US); Chien-Hua Chen, Corvallis, OR (US); Kirby Sand, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/896,980

(22) Filed: Oct. 4, 2010

(65) Prior Publication Data

US 2011/0025782 A1 Feb. 3, 2011

Related U.S. Application Data

(63) Continuation of application No. 11/738,654, filed on Apr. 23, 2007, now Pat. No. 7,828,417.

(51) Int. Cl.
*B41J 2/05* (2006.01)

(52) U.S. Cl. ..... 347/65; 347/71

(58) Field of Classification Search ..... 347/40–43, 347/49, 50, 65–71, 72

See application file for complete search history.

(56) References Cited

U.S. PATENT DOCUMENTS

| | | | | |
|---|---|---|---|---|
| 4,112,436 | A | 9/1978 | Cone | |
| 4,264,714 | A | 4/1981 | Trausch | |
| 4,429,322 | A | 1/1984 | Dressler et al. | |
| 4,626,323 | A | 12/1986 | Trausch | |
| 4,786,303 | A | 11/1988 | Padalino | |
| 5,818,516 | A * | 10/1998 | Rezanka | 347/18 |
| 6,250,738 | B1 | 6/2001 | Waller et al. | |
| 6,406,607 | B1 | 6/2002 | Hirsh et al. | |
| 6,435,653 | B1 | 8/2002 | Boyd et al. | |
| 6,582,064 | B2 | 6/2003 | Cruz-Uribe et al. | |
| 6,718,632 | B2 | 4/2004 | Liu et al. | |
| 6,942,316 | B2 | 9/2005 | Scheffelin et al. | |
| 6,988,791 | B2 | 1/2006 | Conta | |
| 6,997,540 | B2 | 2/2006 | Horvath et al. | |
| 7,213,989 | B2 | 5/2007 | Silverbrook | |
| 7,431,434 | B2 | 10/2008 | Agarwal et al. | |
| 2002/0118254 | A1 | 8/2002 | Wong | |
| 2004/0036751 | A1 | 2/2004 | Giere | |

* cited by examiner

*Primary Examiner* — Thinh Nguyen

(57) ABSTRACT

A microfluidic device includes first and second substrates bonded together. The first substrate has first and second opposed surfaces. A die pocket is formed in the first opposed surface, and a through slot extends from the die pocket to the second opposed surface. The second substrate is bonded to the second opposed surface of the first substrate whereby an outlet of a channel formed in the second substrate substantially aligns with the through slot. The channel of the second substrate has an inlet that is larger than the outlet.

20 Claims, 3 Drawing Sheets

MICROFLUIDIC DEVICE AND A FLUID EJECTION DEVICE INCORPORATING THE SAME

CROSS REFERENCE TO RELATED APPLICATION

This application is a continuation of U.S. patent application Ser. No. 11/738,654, filed Apr. 23, 2007, now U.S. Pat. No. 7,828,417, which is incorporated by reference herein in its entirety.

BACKGROUND

The present disclosure relates generally to microfluidic devices, and to fluid ejection devices incorporating the same.

Inkjet printbars and other fluidic microelectromechanical systems (MEMS) components often include a microfluidic device. Such microfluidic devices are generally formed of ceramic materials or multi-layer metal and/or ceramic materials. Methods of forming microfluidic devices aim to address fundamental issues, including, but not limited to the following: attaching the die to the device with accurate alignment and planarity; achieving fluid interconnect across several orders of magnitude without color mixing between slots; achieving electrical interconnect; forming a device that withstands ink or other fluid attack; and forming such a device in an economical manner.

Satisfying a few of these issues may be possible with any one material or design, however, it remains difficult to satisfy all of the above issues. As an example, multi-layer ceramics are highly flexible in 3D fluidic and electrical interconnect, but are relatively expensive to manufacture. As another example, ceramic devices may be limited in slot pitch and mechanical tolerance, which may render them mis-matched to typical MEMS-fabricated silicon dies. While polymeric materials are relatively inexpensive, they generally are not capable of withstanding prolonged exposure to ink. Furthermore, polymeric materials, in some instances, are not able to maintain their shape when a silicon die is used, in part because of the coefficient of thermal expansion (CTE) mismatch and low modulus.

BRIEF DESCRIPTION OF THE DRAWINGS

Features and advantages of embodiments of the present disclosure will become apparent by reference to the following detailed description and drawings, in which like reference numerals correspond to similar, though not necessarily identical components. For the sake of brevity, reference numerals or features having a previously described function may not necessarily be described in connection with other drawings in which they appear.

DETAILED DESCRIPTION

Embodiments of the microfluidic device disclosed herein are advantageously formed of glass. The glass devices generally include multiple substrates bonded together so that fluidic features defined in each of the substrates substantially align. The fluidic features, inlets thereof, and/or outlets thereof may vary in size and/or shape. The multi-substrate device may be configured to have fan-out fluidic structures or three-dimensional interconnects. The glass substrates may advantageously be configured with pockets for storing electronic circuits, dies, or other devices mounted flush with the substrate surface, thereby making electrical interconnect relatively flexible, robust, and simple. Furthermore, the glass substrates have a coefficient of thermal expansion that is compatible with silicon. It is believed that this enhances device performance during manufacturing (e.g., bonding processes) and during subsequent use (e.g., thermal inkjet printing).

Figure 1:
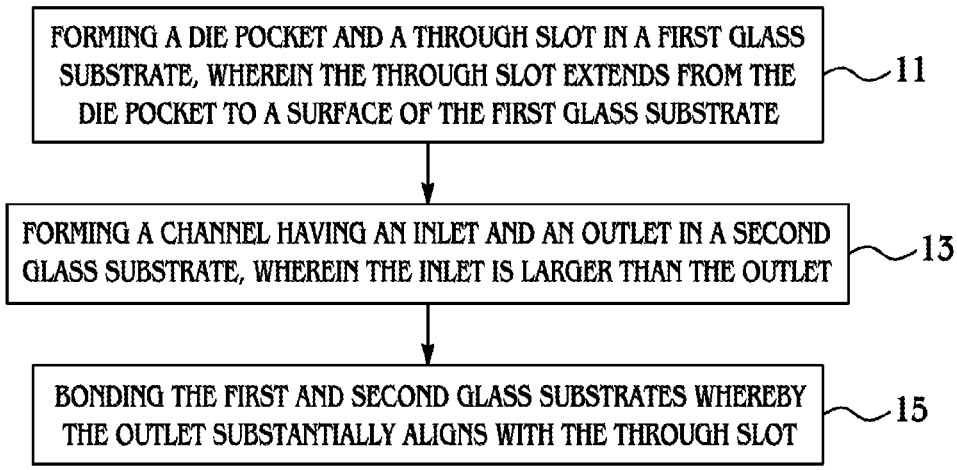
FIG. 1 is a flow diagram depicting an embodiment of a method of forming an embodiment of a microfluidic device.

Referring now to FIG. 1, an embodiment of a method of forming a microfluidic device is depicted. It is to be understood that the microfluidic device formed via the method shown in FIG. 1 is a sub-assembly of a fluid ejection device or array. Generally, the method includes forming a die pocket and a through slot in a first glass substrate, wherein the through slot extends from the die pocket to a surface of the first glass substrate, as shown at reference numeral 11; forming a channel having an inlet and an outlet in a second glass substrate, wherein the inlet is larger than the outlet, as shown at reference numeral 13; and bonding the first and second glass substrates whereby the outlet substantially aligns with the through slot, as shown at reference numeral 15. It is to be understood that embodiments of the method, the microfluidic device, and fluid ejection devices incorporating the microfluidic device(s) are described in further detail in reference to the other figures hereinbelow.

Figure 2A:
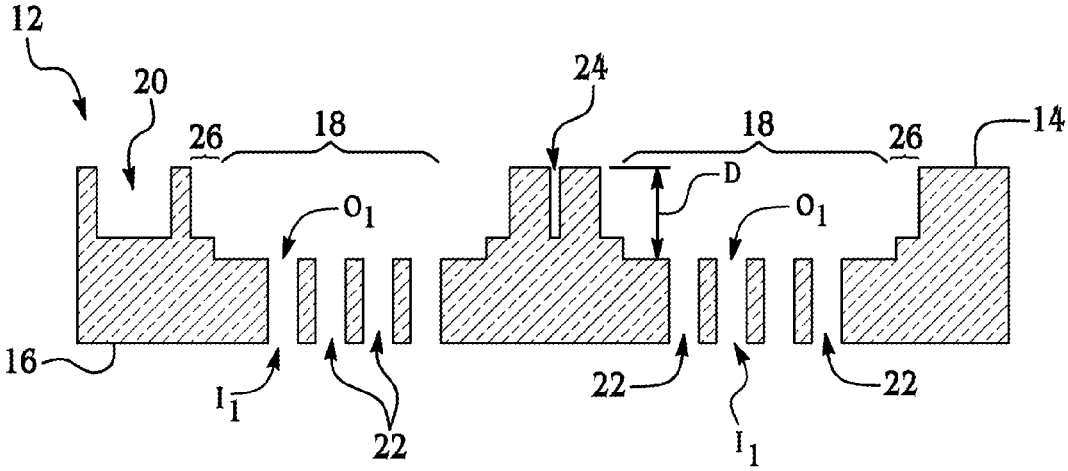
FIG. 2A is a semi-schematic cross-sectional view of an embodiment of a glass substrate having die pockets, through slots, adhesive pockets, and an electronics pocket formed therein.
Figure 2B:
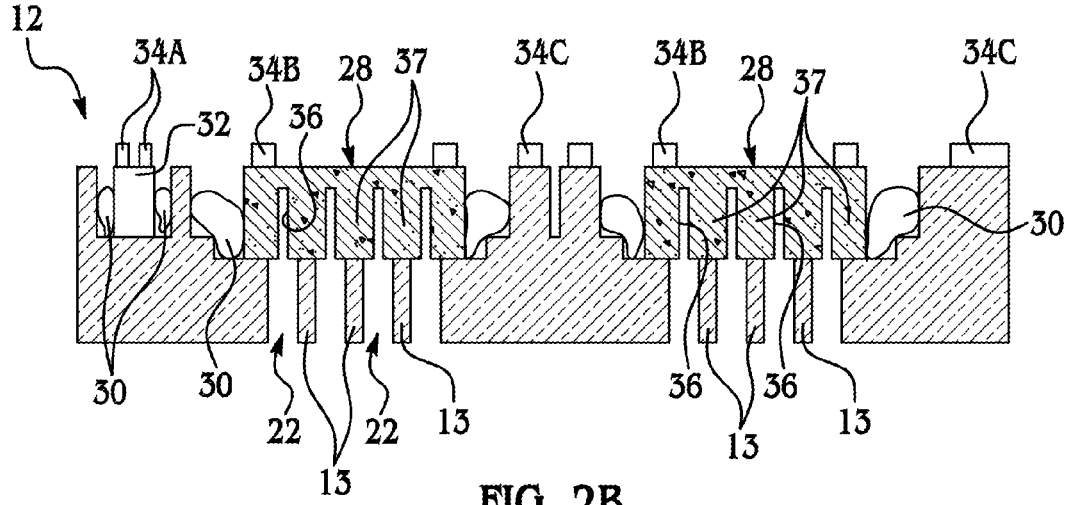
FIG. 2B is a semi-schematic cross-sectional view of the glass substrate of FIG. 2A having two dies and an application specific integrated circuit operatively disposed therein.
Figure 2C:
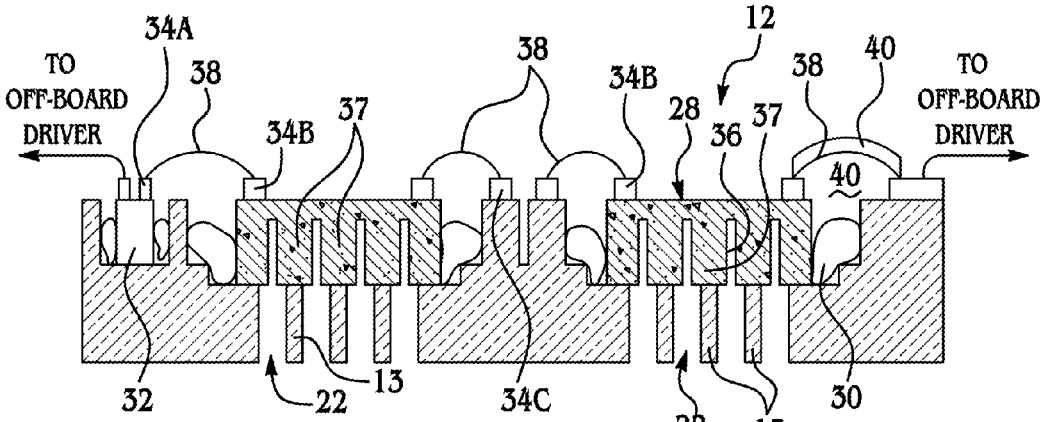
FIG. 2C is a semi-schematic cross-sectional view of the glass substrate of FIG. 2B depicting electrical connections between some of the various components.

FIGS. 2A through 2C depict embodiments of a first glass substrate 12 having various features formed therein, having various components established within some of the features, and having electrical connections established between on- and off-board components, respectively.

FIG. 2A depicts the first glass substrate 12 having first and second opposed surfaces 14, 16. Generally, the first glass substrate 12 is formed of glass suitable for use in display devices, glass suitable for use in MEMS packaging, other like glass materials, or combinations thereof. In an embodiment, the glass substrate 12 is formed of borosilicate glass.

As shown in FIG. 2A, electronic features (e.g., die pocket 18, electronics pocket 20) and fluidic features (e.g., die pocket 18, through slots 22) are defined in the first glass substrate 12. The first glass substrate 12 may also have alignment features (e.g., fiducial 24), adherence features (e.g., adhesive pocket 26), and any other desirable features defined therein. The respective features may be defined in the first glass substrate 12 via molding processes (a non-limiting example of which is a thermal-vacuum glass molding process available through Berliner Glas GMBH, Germany), plasma etching processes, machining processes (e.g., sand blasting), or combinations thereof. It is to be understood that the desirable features may be defined in the glass substrate 12 sequentially or substantially simultaneously.

In an embodiment, the die pocket 18 is formed in the first opposed surface 14 of the glass substrate 12. It is to be understood however, that the die pocket 18 may be formed in either of the opposed surfaces 14, 16. While two die pockets 18 are shown in FIG. 2A, it is to be understood that any number of die pockets 18 may be formed in the first glass substrate 12. The number of die pockets 18 formed generally depends on the number of dies (reference numeral 28, shown in FIG. 2B) that are desirable for the microfluidic device (reference numeral 10, shown in FIG. 4).

As depicted in FIG. 2A, the die pocket 18 extends from the opposed surface 14 into the glass substrate 12 a predetermined depth D that is less than the entire thickness of the glass substrate 12. The depth D, width, and length (the latter two of which are not shown) of the die pocket 18 are selected, at least in part, to have a die 28 (FIG. 2B) operatively positioned therein. In an embodiment, the depth D is selected so that the die 28 (FIG. 2B) embedded therein is substantially planar with the opposed surface 14 of the glass substrate 12. In another embodiment, the depth D is selected so that the die 28 (FIG. 2B) extends beyond the opposed surface 14.

The first glass substrate 12 also has formed therein through slots 22 that extend from the die pocket 18 to the other or second opposed surface 16. In an embodiment in which the die pocket 18 is formed in the second opposed surface 16, the through slots 22 extend to the first opposed surface 14. While a plurality of through slots 22 are shown in FIG. 2A, it is to be understood that any number of through slots 22 may be formed in the first glass substrate 12. In a non-limiting example, the number of through slots 22 depends, at least in part, on the number of fluids used in the device in which the glass substrate 12 is incorporated.

The through slots 22 may be formed to have any desirable size, shape and/or configuration. As non-limiting examples, the through slots 22 have a rectangular or square configuration, a conical configuration, a trapezoidal configuration, an elliptical configuration, a parabolic configuration, an irregular geometric configuration (i.e., not random, but not a regular geometric shape, such configuration may be designed, for example, via a CAD program), or combinations thereof. In an embodiment, the through slots 22 have inlets $I_1$ for receiving fluid, and outlets $O_1$ for exiting fluid therefrom. The through slot inlets $I_1$ and outlets $O_1$ may be the same size or different sizes. In the embodiment shown in FIG. 2A, the inlets $I_1$ and outlets $O_1$ are substantially the same size. In another embodiment, the inlets $I_1$ are larger than the outlets $O_1$. It is to be understood that the inlet $I_1$ and outlet $O_1$ sizes, shapes, and/or configurations may vary as desired, as long as one or more of the inlets $I_1$ are configured to substantially align with a channel 48 of a second glass substrate 42 (see FIGS. 3 and 4), and one or more of the outlets $O_1$ are configured to substantially align with a fluid passage 36 of the die 28 (see FIGS. 2B, 2C and 4).

FIG. 2A also depicts adhesive pockets 26 formed adjacent to the die pockets 18. It is to be understood that the adhesive pockets 26 are generally formed when the die 28 (shown in FIG. 2B) is embedded within the die pocket 18 via adhesive 30 (shown in FIG. 2B). It is to be further understood that when another method of adhering the die 28 in the die pocket 18 is used, an adhesive pocket 26 may not be incorporated into the first glass substrate 12.

In an embodiment, the electronics pocket 20 is formed in the first opposed surface 14 of the glass substrate 12 a spaced distance from the die pocket 18. It is to be understood however, that the electronics pocket 20 may be formed in either of the opposed surfaces 14, 16, as long as the selected opposed surface 14, 16 also has die pocket 18 formed therein. While a single electronics pocket 20 is shown in FIG. 2A, it is to be understood that any number of electronics pockets 20 may be formed in the first glass substrate 12. In an embodiment, the electronics pocket 20 is positioned such that electrical connections may operatively be made between the electronic device (reference numeral 32 shown in FIG. 2B) positioned within the electronics pocket 20 and the die 28 (see FIG. 2B) positioned within the die pocket 18, and/or an off-board driver or other off-board electronic device.

It is to be understood that the electronics pocket 20 extends from the opposed surface 14 into the glass substrate 12. The depth, width, and length of the electronics pocket 20 are selected, at least in part, to have an electronic device (reference numeral 32, shown in FIG. 2B) operatively positioned therein. In an embodiment, the depth is selected so that the electronic device 32 (FIG. 2B) embedded therein is substantially planar with the opposed surface 14 of the glass substrate 12. It is to be understood however, that the electronic device 32 may extend beyond the opposed surface 14, or the opposed surface 14 may extend beyond the operatively positioned electronic device 32.

As previously stated, FIG. 2A also depicts a fiducial 24 defined in the first opposed surface 14 of the first glass substrate 12. It is to be understood that any desirable number of fiducials 24 may be formed in the first glass substrate 12. The fiducial(s) 24 may advantageously aid in alignment of the first glass substrate 12 with the second glass substrate 42 (shown in FIG. 3), and alignment of the formed microfluidic device 10 (shown in FIG. 4) in a fluid ejection device 100 (also shown in FIG. 4). Fiducials 24 may also be formed in the die 28 to aid in its alignment with the first glass substrate 12. The fiducials may be formed via the same molding processes as used to form the respective pockets in the first glass substrate 12, or via other suitable methods common in the MEMS field, such as, for example laser direct-writing or shadow-mask metal deposition.

Referring now to FIG. 2B, an embodiment of the first glass substrate 12 is shown having the die 28, adhesive 30, the electronic device 32, and interconnect pads/conductors 34A, 34B, 34C embedded or established therein or thereon.

In an embodiment, the electronic device 32 is positioned within the electronics pocket 20. Non-limiting examples of the electronic device 32 include application specific integrated circuits (ASICS), other integrated circuits, power supplies or converters, passive components (e.g., resistors, inductors, capacitors, or the like), or other like devices. The electronic device 32 may be adhered to the glass substrate 12 via adhesive 30, solder bonding, plasma bonding, plasma enhanced bonding, anodic bonding, thermo-compression or ultrasonic welding, fusion bonding, or other such bonding techniques suitable for electronics component or MEMS packaging.

As shown in FIG. 2B, the electronic device 32 has interconnect pads/conductors 34A established thereon. It is to be understood that the electronic device 32 may be embedded within the electronics pocket 20 before or after the pads/conductors 34A are deposited thereon. In one embodiment, the pads/conductors 34A are established on the electronic device 32 prior to it being embedded in the pocket 20. In another embodiment, the pads/conductors 34A are formed as the electronic device 32 is being formed. As a non-limiting example, a photo-patternable material is dry film laminated to the electronic device 32, the photo material is exposed and developed, a metal is deposited, and the photo material is stripped.

FIG. 2B also depicts the die 28 embedded within the die pocket 18. In an embodiment, the die 28 is a thermal actuated or piezo-actuated inkjet device or other MEMS fluidic component. It is believed that the glass substrate 12 has a coefficient of thermal expansion that is compatible with the selected die, thereby enhancing device durability.

It is to be understood that the die 28 may be embedded before or after the electronic device 32 is embedded. Non-limiting examples of suitable techniques for embedding the die 28 in the pocket 18 include adhesive bonding (using adhesive 30 in adhesive pockets 26), plasma bonding, anodic bonding, solder bonding, glass frit bonding, and/or any other suitable bonding process, and/or combinations thereof. It is to be understood that such processes result in fluidically leak-proof bonding between the ribs 37 of the die 28 and ribs 13 of the first glass substrate 12, such that each through slot 22 is fluidly isolated from each other slot 22. The die 28 is embedded so that each fluidic passage 36 inlet substantially aligns with an outlet $O_1$ of one of the through slots 22. During use, fluid flows from the through slots 22 into the fluidic passages 36 of the die 28 for ejection therefrom.

The phrases "substantially align(s)", "substantially aligned", or the like, as used herein, mean that respective inlets and outlets abut to form a fluid route whereby fluid is operatively moved through the channels 48 (shown in FIG. 3), through the through slots 22, and into the passages 36, for ejection therefrom. It is to be understood that abutting inlets and outlets may or may not have the same size, shape and/or configuration, as long as the fluid flowing from a respective outlet is capable of entering an abutting inlet substantially without leaking. In some embodiments, the outlets are larger than the inlets. Furthermore, as a non-limiting example, rounded outlets may abut rectangular inlets.

In an embodiment, interconnect pads/conductors 34B are also established on the embedded die 28. Such pads/conductors 34B are generally established via shadow-mask deposition processes or lift-off processes before the die 28 is embedded within the pocket 18. In some embodiments, the pads/conductors 34B are formed during the die 28 formation process.

Pads/conductors 34C are also established on areas of the glass substrate 12, for example, at areas adjacent the respective die pockets 18 or adhesive pockets 26. In an embodiment, the pads/conductors 34C are established via shadow-mask deposition processes. In another embodiment, a lift-off process may be used to establish the pads/conductors 34C. It is to be understood that the pads/conductors 34C may be established on the glass substrate 12 before or after the various components (e.g., die 28, electronic device 32) are embedded in the respective pockets (e.g., die pocket 18, electronics pocket 20). In some embodiments, the second glass substrate 42 (shown in FIG. 3) also has pads/conductors (not shown) established thereon. If wire or TAB bonds (described further hereinbelow) are formed between pads/conductors 34B, 34A on the die 28 and the electronic device 32, pads/conductors 34C on the glass substrate(s) 12, 42 may not be included in the device 10.

FIG. 2C depicts the embodiment of the first glass substrate 12 shown in FIG. 2B with electrical connections 38 made between two adjacent pads/conductors 34A, 34B, 34C or between a pad/conductor 34A, 34B, 34C and an off-board driver (not shown). In an embodiment, one electrical connection 38 connects one pad/conductor 34A established on the electronic device 32 to an off-board driver and another electrical connection 38 connects another of the pad/conductor 34A established on the electronic device 32 to a pad/conductor 34B established on one of the dies 28. Electrical connections 38 may also connect pads/conductors 34B on the dies 28 to pads/conductors 34C established on the opposed surface 14 of the glass substrate 12.

Electrical connections 38 may be formed via wire bonding, tape automated bonding (TAB), flip chip bonding, or combinations thereof. In an embodiment, one or more of the electrical connections 38 are covered with an epoxy encapsulant (ENCAP) 40. An ENCAP may be desirable when wire bonds are used as electrical connections 38. As shown in FIG. 2C, epoxy seals the connection 38 at the edge of the electrically connected or bonded die 28. The epoxy material provides both mechanical support and environmental protection for the electrical connection 38.

Figure 3:
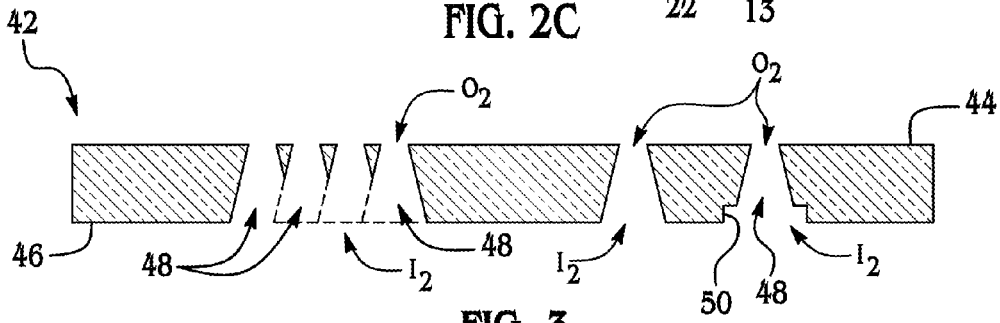
FIG. 3 is a schematic cross-sectional view of an embodiment of another glass substrate having staggered channels defined therein.

Referring now to FIG. 3, an embodiment of a second glass substrate 42 having two opposed surfaces 44, 46 is shown. Channels 48 are formed in the second glass substrate 42 such that an outlet $O_2$ is located at one of the opposed surfaces 44, 46, and an inlet $I_2$ is located at the other of the opposed surfaces 46, 44. Each channel 48 is configured so that the inlet $I_2$ is larger than the outlet $O_2$.

While it appears in FIG. 3 that the channels 48 intersect, it is to be understood that each channel 48 formed in the second glass substrate 42 is isolated from each of the other channels 48. The schematic view of FIG. 3 is merely illustrative of the fact that this embodiment of the glass substrate 42 has a total of six channels 48 defined therein. The channels 48 are configured and/or are staggered throughout the glass substrate 42 such that each channel 48 is isolated.

The channels 48 are formed in the second glass substrate 42 via any of the techniques previously described for forming the features in the first glass substrate 12 (e.g., molding, plasma etching, sand blasting, etc.).

It is to be understood that the channels 48 may be formed to have any desirable size, shape and/or configuration, as long as the inlet $I_2$ is larger than the outlet $O_2$. As non-limiting examples, the channels 48 have a conical configuration, a trapezoidal configuration, an elliptical configuration, a parabolic configuration, an irregular geometric configuration (i.e., not a random, but not a regular geometric shape; such a configuration may be designed, for example, via a CAD program), or combinations thereof.

The inlet $I_2$ of the channel(s) 48 may be formed with additional space 50 formed adjacent the opposed surface 46. This space 50 may removably receive a seal (not shown) for a fluid feed tube (reference numeral 52 shown in FIG. 4), which is fluidly connected to a fluid supply.

Figure 4:
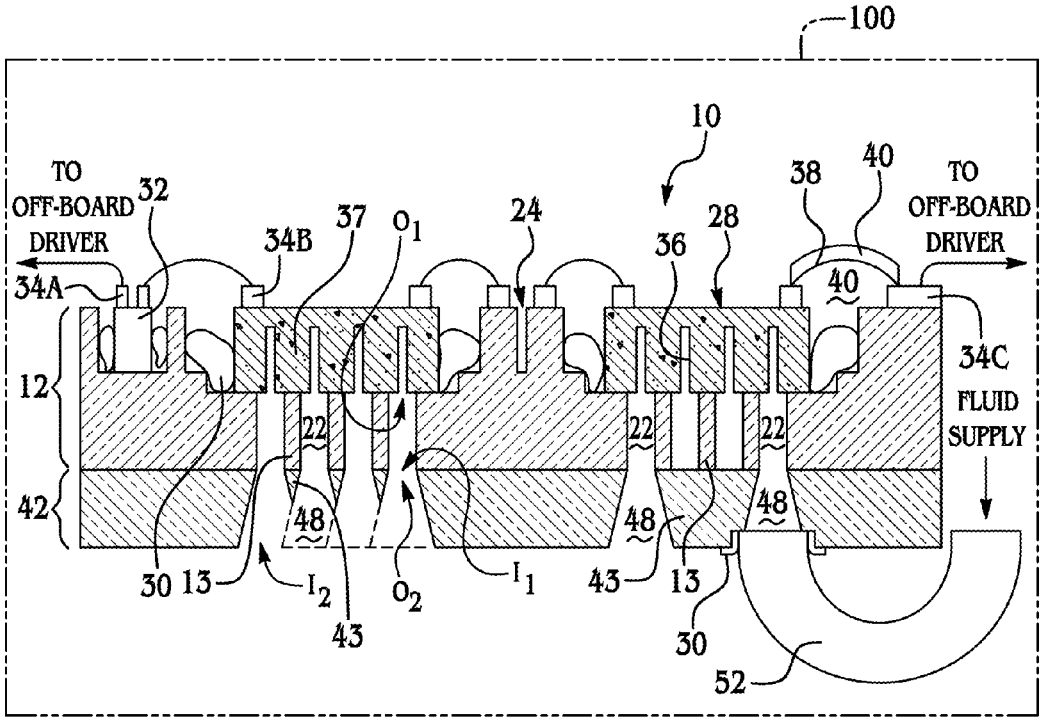
FIG. 4 is a semi-schematic cross-sectional view of an embodiment of a microfluidic device having the glass substrate of FIG. 2C and the glass substrate of FIG. 3 bonded together.

FIG. 4 depicts the microfluidic device 10 that is formed when the first glass substrate 12 is bonded to second glass substrate 42. The embodiment shown in FIG. 4 has various electronic components (die 28, electronic device 32, etc.) operatively connected to the first glass substrate 12. Embodiments of the microfluidic device 10 disclosed herein are suitable for use (e.g., as carriers) in a variety of fluid ejection devices 100, including, but not limited to inkjet printers, fluidic MEMS devices (e.g., DNA analysis chips, micro-reactors, spray nebulizers, etc.), or the like, or combinations thereof.

The first and second glass substrates 12, 42 may be bonded together via anodic bonding, plasma bonding, adhesive bonding, solder bonding, compression bonding or welding, glass frit bonding, or combinations thereof. It is to be understood that such processes result in fluidically leak-proof bonding between the ribs 13 of the first glass substrate 12 and ribs 43 of the second glass substrate 42, such that each channel 48 is fluidly isolated from each other channel 48. It is believed that the glass substrates 12, 42 and the interfaces created via bonding enhance device 10 durability during manufacture and subsequent use. It is to be understood that the first and second glass substrates 12, 42 may be bonded together prior to embedding/establishing the die 28 and/or the other components, after embedding/establishing the die 28 and/or the other components, or during embedding of the die 28 and/or the other components (e.g., when adhesive bonding is used for embedding components and for bonding the substrates 12, 42).

As indicated hereinabove, the substrates 12, 42 are bonded such that the outlet $O_2$ of a respective channel 48 substantially aligns with the inlet $I_1$ of a respective through slot 22. In one embodiment, every through slot 22 of the first glass substrate 12 aligns with a respective channel 48 of the second glass substrate 42. In another embodiment, as shown in FIG. 4, less than all of the through slots 22 are aligned with a respective channel 48. It is to be understood that any number of slots 22 may be aligned with respective channels 48. The number of aligned slots 22 may depend, at least in part, on the desired end use of the microfluidic device 10.

FIG. 4 also depicts a fluid feed tube 52 operatively and fluidly connected to one of the channels 48 at its inlet $I_2$. The fluid feed tube 52 may be connected to the second glass substrate 42 via adhesive 30, solder bonding, or any other suitable bonding process. While one of the channels 48 is shown having the fluid feed tube 52 in fluid communication therewith, it is to be understood that any number of the channels 48 may be connected to a respective fluid feed tube 52.

The fluid feed tube 52 connects a fluid supply to the device 10. In operation, fluid is directed from the supply, through the fluid feed tube 52, and into the channel 48 of the second glass substrate 42. The fluid is then directed through the outlet $O_2$ of the channel 48 into the inlet $I_1$ of the through slot 22. The fluid enters the passage 36 of the die 28 from which it is ejected. In one embodiment, the same fluid is delivered to each of the channels 48, and in another embodiment, a different fluid is delivered to each of the channels 48. The fluids will vary, depending, at least in part, on the use for the device 10. Non-limiting examples of such fluids include inkjet inks (same or different colors), biological samples (e.g., for assay), fuels (e.g., for fuel-injection), environmental samples (e.g., air or water samples for assay), micro-chemical reactor fluids, liquid-borne catalysts for micro-chemical reactor fluids, and/or combinations thereof.

Figure 5A:
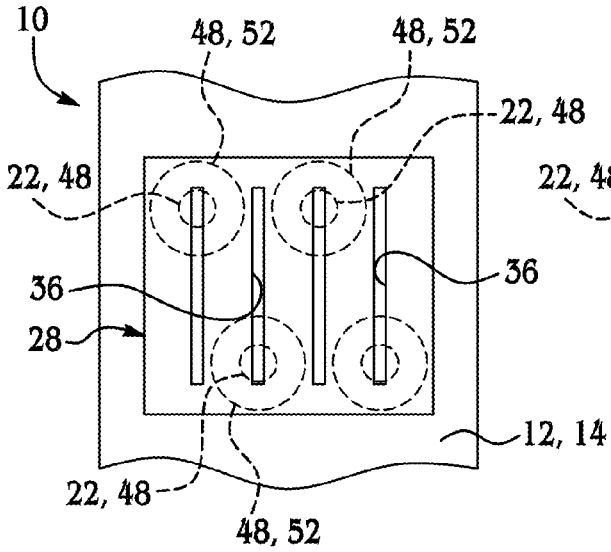
FIGS. 5A and 5B depict schematic top cutaway views of embodiments of microfluidic devices wherein the die is fluidly connected to staggered through slots and channels.
Figure 5B:
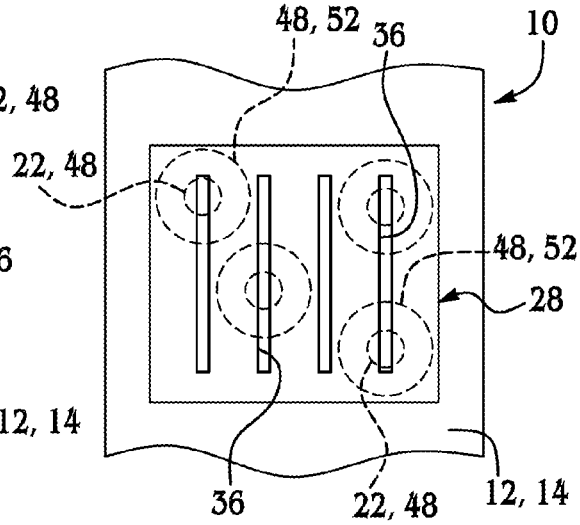

FIGS. 5A and 5B depict schematic tops view of the portion of the device 10 where the die 28 is embedded. These figures illustrate how the through slots 22 and channels 48 may be staggered within the respective first and second glass substrates 12, 42. In both figures, the larger circles labeled 48, 52 represent the interconnect interface between the inlet $I_2$ of the channel 48 and the fluid feed tube 52, and the smaller circles labeled 22, 48 represent the interconnect interface between the outlet $O_2$ of the channel 48 and the inlet $I_1$ of the through slot 22. In FIG. 5A, each fluid passage 36 of the die 28 is fluidly connected to a respective through slot 22 and channel 48. In FIG. 5B, one of the passages 36 is fluidly connected to multiple through slots 22 and channels 48, while another of the passages 36 is not utilized. It is believed that the staggered configuration shown in FIG. 5B enables the diameter of the interconnect 48, 52 between the inlet $I_2$ of the channel 48 and the fluid feed tube 52 to be maximized.

Figure 6:
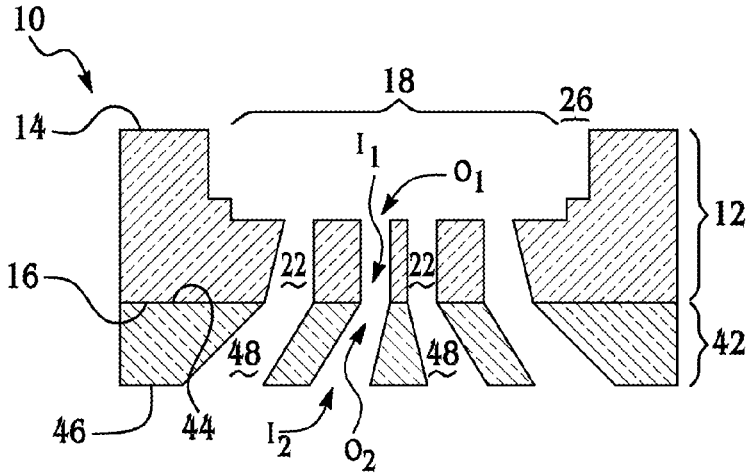
FIG. 6 is a semi-schematic cross-sectional view of another embodiment of the microfluidic device.
Figure 7:
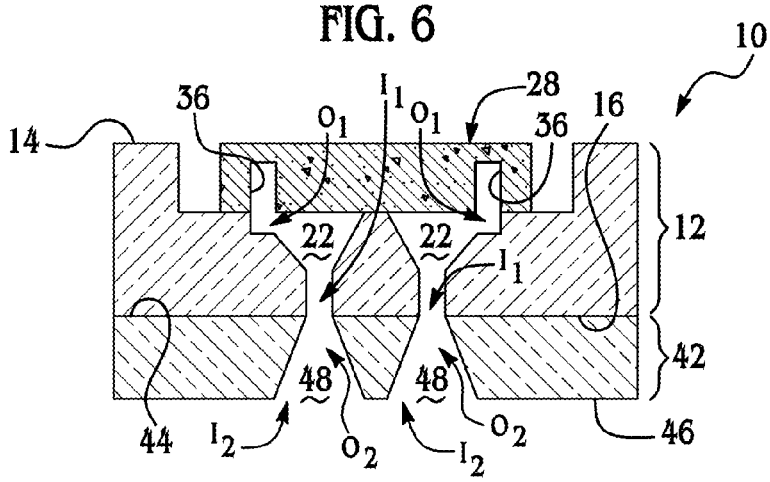
FIG. 7 is a semi-schematic cross-sectional view of still another embodiment of the microfluidic device having a die embedded therein.

FIGS. 6 and 7 depict other embodiments of the through slots 22 in the first glass substrate 12 and the channels 48 in the second glass substrate 42.

FIG. 6 illustrates a fan out structure for each through slot 22 and each channel 48. The previously mentioned glass molding process may not be particularly desirable for forming the substrates 12, 42 shown in FIG. 6. This may be due, at least in part, to the potential difficulty with removing the mold once the fan out configuration of the slots 22 and channels 48 is formed. For this embodiment, other methods (e.g., ultrasonic machining, etching, etc.) may be more desirable.

As depicted in FIG. 6, the respective inlets $I_1$ and $I_2$ of the through slot 22 and the channel 48 are larger than the respective outlets $O_1$ and $O_2$. It is believed that the large size difference between channel inlet $I_2$ and the through slot outlet $O_1$, and the smooth geometric transition between the sizes is achievable using the methods disclosed herein, in part, because configuring each of the glass substrates 12, 42 separately is easier than configuring a thicker single piece of glass with a similar geometry.

FIG. 7 depicts two through slots 22 having irregular geometric shapes, or a combination of regular geometric shapes (trapezoidal, rectangular). In an embodiment (as shown in FIG. 7), the larger area (near the outlets $O_1$) of the through slots 22 does not extend through to the surface 16, rather the inlets $I_1$ are smaller than the respective outlets $O_1$. In this embodiment, a portion of each outlet $O_1$ abuts the die 28 (thereby impeding fluid from exiting at this point), and a portion of each outlet $O_1$ abuts the die fluid passage 36 (where fluid exits). In this embodiment, the fluid flow is substantially vertical, and then substantially horizontal through the through slots 22. In another embodiment, the channels 48 are larger than the slots 22 so the ink enters the microfluidic device 10 from a large outlet $O_2$ and travels through a smaller outlet $O_1$ to reach die fluid passage 36.

In still another embodiment not shown in the figures, a third glass substrate may be bonded between the first and second glass substrates 12, 42 (using bonding techniques described hereinabove). It is to be understood that the third substrate is configured to fluidly connect the through slots 22 of the first glass substrate 12 with the channels 48 of the second glass substrate 42. It is to be further understood that any number of substrates may be interposed between the first and second glass substrates 12, 42, as long as the through slots 22 and the channels 48 are fluidly connected. Intermediate substrates may advantageously transition the scale of the fluidics from large inlets to small outlets in a relatively smooth fashion.

A third glass substrate may also be bonded to the second glass substrate 42 at surface 46. In this embodiment, the third glass substrate is configured with a single slot or channel that is fluidly connected to multiple channels 48. As such, the slot or channel of the third substrate receives fluid via one fluid feed tube 52 (shown in FIG. 4), and supplies the received fluid to multiple channels 48 that are in fluid communication therewith. With such an embodiment, a single fluid is supplied to multiple channels 48 and through slots 22 via one fluid feed tube 52. Such a configuration may be desirable, for example, when the same ink color is to be supplied to multiple channels 48.

In still another embodiment, the device 10 includes both an additional substrate between the first and second glass substrates 12, 42, and an additional substrate attached to the opposed surface 46 of the second glass substrate 42.

While several embodiments have been described in detail, it will be apparent to those skilled in the art that the disclosed embodiments may be modified. Therefore, the foregoing description is to be considered exemplary rather than limiting.

What is claimed is:

1. A microfluidic device, comprising:

a first substrate having first and second opposed surfaces, the first substrate having a die pocket formed in the first opposed surface, and a through slot extending from the die pocket to the second opposed surface; and a second substrate bonded to the second opposed surface of the first substrate whereby an outlet of a channel formed in the second substrate substantially aligns with the through slot, wherein the channel has an inlet that is larger than the outlet.

2. The microfluidic device as defined in claim 1 wherein the first glass substrate includes a plurality of through slots, wherein the second substrate includes a plurality of channels, and wherein each one of the through slots aligns with a respective one of the plurality of channels.

3. The microfluidic device as defined in claim 2 wherein the plurality of channels is staggered within the second substrate.

4. The microfluidic device as defined in claim 1 wherein the first substrate has formed therein an adhesive pocket adjacent the die pocket.

5. The microfluidic device as defined in claim 1 wherein the first substrate has formed therein a fiducial.

6. The microfluidic device as defined in claim 1 wherein the first substrate has formed therein an electronics pocket separate from the die pocket, and wherein the microfluidic device further comprises an electronic device embedded in the electronics pocket.

7. The microfluidic device as defined in claim 1 wherein the channel has a substantially conical configuration, a trapezoidal configuration, an elliptical configuration, a parabolic configuration, an irregular configuration, or combinations thereof.

8. The microfluidic device as defined in claim 1, further comprising a fluid feed tube operatively coupled to the channel formed in the second substrate.

9. A method of making a microfluidic device, the method comprising:

forming a die pocket and a through slot in a first substrate, wherein the through slot extends from the die pocket to a surface of the first substrate;

forming a channel having an inlet and an outlet in a second substrate, wherein the inlet is larger than the outlet; and bonding the first and second substrates whereby the outlet substantially aligns with the through slot.

10. The method as defined in claim 9 wherein forming at least one of the die pocket, the through slot, or the channel is accomplished via molding, plasma etching, machining processes, or combinations thereof.

11. The method as defined in claim 9, further comprising forming an adhesive pocket directly adjacent to the die pocket.

12. The method as defined in claim 11 wherein forming the adhesive pocket, the die pocket, and the through slot occurs substantially simultaneously.

13. The method as defined in claim 11, further comprising:

positioning a die in the die pocket; and establishing adhesive in the adhesive pocket, thereby adhering the die to the first substrate.

14. The method as defined in claim 9 wherein the die pocket is formed in an other surface of the first substrate, and wherein the method further comprises:

forming an electronics pocket in the other surface of the first substrate adjacent to and spaced from the die pocket;

embedding an electronic device in the electronics pocket;

embedding a die in the die pocket; and electrically connecting the electronic device to the die.

15. The method as defined in claim 14 wherein at least one of embedding the electronic device or embedding the die is accomplished via adhesive bonding, solder bonding, thermocompression welding, ultrasonic welding, fusion bonding, plasma bonding, anodic bonding, plasma enhanced bonding, or combinations thereof.

16. A microfluidic device formed by the process of claim 9.

17. The method as defined in claim 9, further comprising embedding a die in the die pocket, wherein embedding is accomplished before bonding the first and second substrates, after bonding the first and second substrates, or during bonding of the first and second substrates.

18. The method as defined in claim 17 wherein forming the die pocket includes configuring a die pocket depth whereby the die embedded within the die pocket is substantially planar with an other surface of the first substrate.

19. The method as defined in claim 9, further comprising attaching a fluid feed tube to the inlet of the channel.

20. A microfluidic device, comprising:

a first substrate having first and second opposed surfaces, the first substrate being configured to receive a die on the first opposed surface, and having a through slot extending from the first opposed surface to the second opposed surface; and a second substrate bonded to the second opposed surface of the first substrate whereby an outlet of a channel formed in the second substrate substantially aligns with the through slot, wherein the channel has an inlet that is larger than the outlet.

* * * * *

UNITED STATES PATENT AND TRADEMARK OFFICE

CERTIFICATE OF CORRECTION

PATENT NO. : 8,007,078 B2
APPLICATION NO. : 12/896980
DATED : August 30, 2011
INVENTOR(S) : Charles C Haluzak et al.

It is certified that error appears in the above-identified patent and that said Letters Patent is hereby corrected as shown below:

In column 9, line 17, in Claim 2, after "first" delete "glass".

Signed and Sealed this
Twenty-eighth Day of February, 2012

David J. Kappos

David J. Kappos
*Director of the United States Patent and Trademark Office*